US006097152A

United States Patent [19]

Nieda

[11] Patent Number: 6,097,152

[45] Date of Patent: Aug. 1, 2000

[54] COMPOSITE DISCHARGE LAMP HAVING CENTER, ARC ELECTRODES COATED FOR ELECTRON EMISSION

[75] Inventor: Yoriyuki Nieda, Kamakura, Japan

[73] Assignee: Tokyo Densoku Kabushiki Kaisha, Kanagawa-ken, Japan

[21] Appl. No.: 08/939,933

[22] Filed: Sep. 29, 1997

Related U.S. Application Data

[63] Continuation of application No. 08/551,574, Nov. 1, 1995, which is a continuation of application No. 08/240,987, May 11, 1994, abandoned.

[30] Foreign Application Priority Data

May 20, 1993 [JP] Japan ..... 5-118059

[51] Int. Cl.[7] ..... H01J 61/06

[52] U.S. Cl. ..... 313/632; 313/113; 313/492; 313/613; 313/632; 313/352

[58] Field of Search ..... 313/634, 113, 313/492, 574, 613, 631, 632, 479, 326, 352, 240

[56] References Cited

U.S. PATENT DOCUMENTS

| | | | |
|---|---|---|---|
| 2,128,270 | 8/1938 | Spanner et al. | 313/632 |
| 2,692,350 | 10/1954 | Arnott | 313/310 |
| 2,917,650 | 12/1959 | Caumont | 313/613 |
| 3,215,882 | 11/1965 | Toomey | 313/492 |
| 4,032,814 | 6/1977 | Shurgan et al. | 313/492 |
| 5,214,351 | 5/1993 | Nieda | 313/632 |

*Primary Examiner*—Ashok Patel
*Attorney, Agent, or Firm*—Ladas & Parry

[57] ABSTRACT

A composite glow discharge lamp having an elongated glass tube, in which an electrode assembly is located in said elongated glass tube at each of opposite ends thereof, the electrode assembly comprising a center electrode for emitting electrons and a glow electrode surrounding the center electrode, and the glow electrode being formed of an enclosure having an opening and a closed bottom and laid so that the opening faces the opposite end of the glass tube which is near thereto, and the closed bottom faces the longitudinally middle part of the glass tube, thereby it is possible to prevent blackening of the glass tube, and to prolong the use life of the composite discharge lamp.

12 Claims, 6 Drawing Sheets

COMPOSITE DISCHARGE LAMP HAVING CENTER, ARC ELECTRODES COATED FOR ELECTRON EMISSION

This application is a continuation of Ser. No. 08/551,574 filed Nov. 1, 1995 which is a continuation of Ser. No. 08/240,987 filed May 11, 1994 abn.

BACKGROUND OF THE INVENTION

The present invention relates to a composite discharge lamp such as a hot-cathode low pressure fluorescent discharge lamp having a glass tube incorporating electrode assemblies each of which is composed of a center electrode for emitting electrons and a glow electrode surrounding the center electrode, and which are located at positions which are near opposite ends of the elongated glass tube, respectively.

RELATED ART OF THE INVENTION

Hot-cathode low pressure fluorescent discharge lamps, that is, the so-called fluorescent lamps are widely available as light sources having a high degree of efficiency, as is similar to light bulbs.

A filament coil cathode electrode in a fluorescent lamp is coated thereover with an electron emitting substance (which will be hereinbelow denoted as "emitter") which is mainly composed of barium, strontium and calcium, and which is consumed by scattering due to ion bombardment onto the cathode electrode and by its evaporization during turn-on of the discharge lamp, whereby the lamp cannot be lit or the useful life of the lamp terminates.

There has been proposed a conventional fluorescent lamp in which an anode is attached to the filament coil cathode electrode so as to disperse the ion bombardment in order to prolong the life of the fluorescent lamp. However, the attachment of the anode causes the light to flicker, and accordingly, substantially no such fluorescent lamps are used at present.

The structure of an electrode assembly in a conventional cold-cathode or hot-cathode discharge lamp is composed of a filament (center electrode) and a glow electrode surrounding the filament. The glow electrode is an enclosure having an opening and a closed bottom. The opening of the glow electrode faces the middle part of the elongated glass tube in which the electrode assembly is incorporated, and the closed bottom of the glow electrode faces the end of the glass tube nearest thereto.

The above-mentioned conventional fluorescent lamp has the following disadvantages:

(1) the useful life of the lamp is short, that is, 4,000 to 5,000 hours;

(2) darkening occurs at opposite end parts of the glass tube; and (3) large heat generation occurs in the later period of the useful life of the lamp.

As mentioned above, the opening of the glow electrode in the conventional fluorescent lamp faces the middle part of the glass tube so that the filament cathode electrode surrounded by the glow electrode is exposed to ions or electrons. Although various improvements have been applied to an emitter or to the gas pressure in the glass tube of the conventional fluorescent lamps, it has been impossible to sufficiently prevent the life of the fluorescent lamp from being shortened due to ion bombardment.

SUMMARY OF THE INVENTION

The present invention is devised in order to eliminate the above-mentioned disadvantages, and accordingly, one object of the present invention is to provide a composite discharge lamp which can eliminate the above-mentioned disadvantages.

To this end, according to the present invention, there is provided a composite discharge electrode comprising an elongated glass tube (such as a rod-like glass tube or a ring-like glass tube) having a longitudinally middle part and longitudinally opposite ends, and electrode assemblies each of which is composed of a center electrode for emitting electrons and a glow electrode surrounding the center electrode, and which are located near the longitudinally opposite ends of the glass tube, respectively, the glow electrode being an enclosure having an opening facing one of the longitudinally opposite ends of the glass tube, which is nearest thereto, and a closed bottom facing the longitudinally middle part of the glass tube.

Hence the glow electrode according to the present invention, is arranged, in reverse to that of the conventional fluorescent lamp, that is, the opening of the glow electrode faces one of the longitudinally opposite ends of the glass tube, which is nearest thereto, while the bottom of the glow electrode faces the longitudinally middle part of the glass tube, whereby thermal electrons (including secondary electrons caused by glow discharge) first out through the opening of the glow electrode, toward the end of the glass tube. The bottom of the glow electrode is bombarded with ions which are generated under electric discharge, and the thus obtained bombardment energy serves as a secondary electron discharge energy which increases the tube current. In the conventional technology, it has been considered that ions are detrimental to a discharge lamp since it raises the problem of ion bombardment. However, according to the present invention, the function of the ions can be effectively used.

Other features and advantages of the present invention will be apparent from the following description taken in connection with the accompanying drawings wherein:

DETAILED DESCRIPTION OF THE PREFERRED EMBODIMENTS

Figure 1:
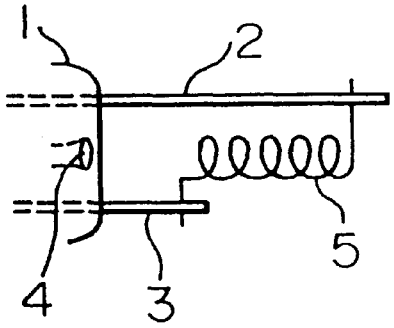
FIG. 1 is an explanatory view illustrating the structure of an electrode assembly in a fluorescent lamp in general.
Figure 2:
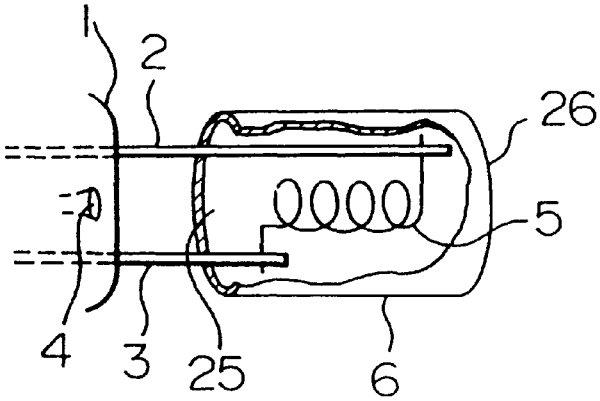
FIG. 2 is an explanatory view illustrating the structure of an electrode assembly in a composite discharge lamp according to the present invention.

Referring to FIG. 1 which shows an electrode assembly in a fluorescent lamp, the electrode assembly is composed of a filament coil electrode 5 coated thereover with an electron emitting substance, and lead wires 2, 3 through which current is applied to the filament coil electrode 5. The lead wires 2, 3 are attached to a stem 1 having a vent hole 4. Referring to FIG. 2 which shows a glow electrode 6 in addition to the electrode 5 shown in FIG. 1. The glow electrode 6 is made of aluminum, nickel, sintered metal mainly composed of an electron emitting material or the like, and is cylindrical, having an opening 25 and a closed bottom 26. The lead wire 2 is spot-welded or caulked to the glow electrode 6, and the opening 25 is arranged to face the stem 1.

Fluorescent lamps having the electrode assembly shown in FIG. 2, and fluorescent lamps having the electrode assembly shown in FIG. 1 were prepared and compared with each other with respect to the lighting thereof. A glow starter circuit of a.c. 100 voltage at 50 Hz was used as a power source.

The fluorescent lamp having the electrode assembly as shown in FIG. 1 exhibited a luminance of 9,000 nt (which was measured at the middle of the lamp) under a power of 10.1 W with a current value of 215 mA at a voltage 47 V, and the fluorescent lamp having the electrode assembly shown in FIG. 2 exhibited a luminance of 9,500 nt (which was measured at the middle of the lamp) under a power of 10.1 W with a current value of 225 mA at a lamp voltage 45 V.

Figure 3:
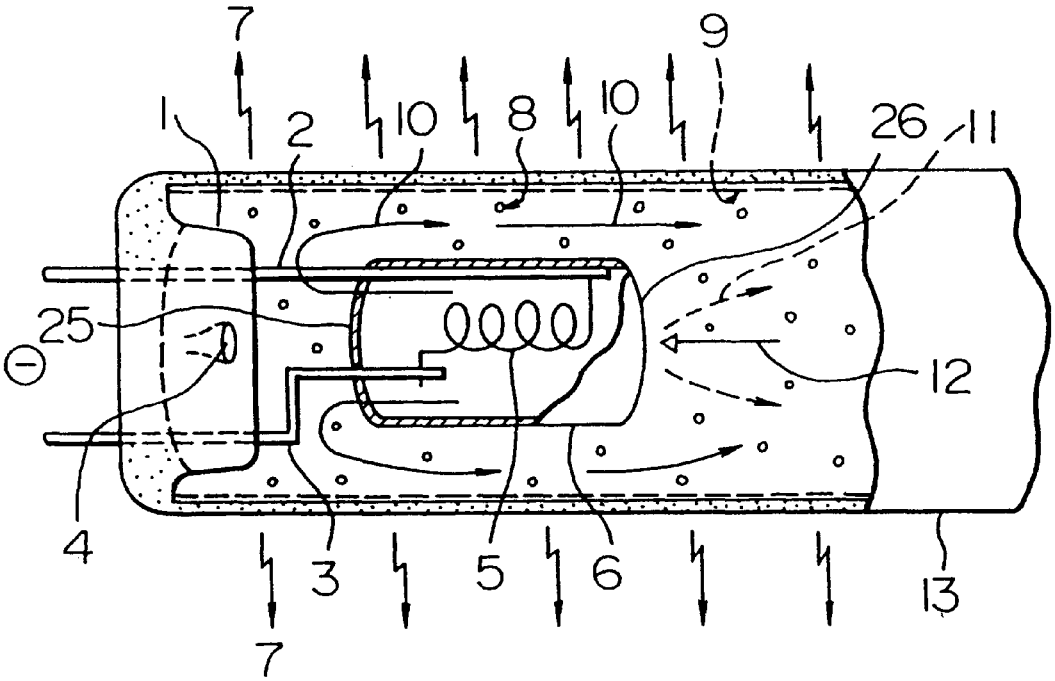
FIG. 3 is a schematic explanatory sectional view illustrating the arrangement of a part of a composite discharge lamp in a first embodiment of the present invention, incorporating the electrode assembly shown in FIG. 2.

Referring to FIG. 3 which shows one end part of a composite discharge lamp in a first embodiment of the present invention, incorporating the electrode assembly shown in FIG. 2, a filament coil center electrode 5 is composed of double filament coils, and a glow electrode 6 has an outer diameter of 8 mm, a length of 10 mm and a wall thickness of 0.15 mm and is made of aluminum having a purity of about 95%.

As shown in FIG. 3, it has been understood from the above-mentioned experiments in comparison that the intensity of light does not decrease even though the glow electrode 6 is capped on the filament coil center electrode 5, but it rather increases by about 5%.

With the use of the electrode assembly as shown in FIG. 1, the filament coil center electrode 5 is bombarded with ions so that the electron emitting substance, that is, the emitter is sputtered by the energy of the ion bombardment, resulting in a shortened life of the fluorescent lamp, and further, in large heat generation in the later part of the lamp life. On the contrary, with the use of the electrode-assembly shown in FIGS. 2 and 3, according to the present invention, only the bottom and the side wall of the glow electrode is bombarded with ions 12, and the energy of the ion bombardment is absorbed over the wide entire outer wall surface of the glow electrode 6 so as to emit a large volume of secondary electrons 11, resulting in an increase in lamp current.

Referring to FIG. 3, if the electrode assembly as shown is set on the negative (−) side, the thermal electrons 10 generated from the filament coil center electrode 5 pass through the opening 25 of the glow electrode 6, and then through a gap between the outer peripheral surface of the glow electrode 6 and the inner peripheral surface of the glass tube 13, being attracted by an electrode assembly on the positive (+) side which is not shown so as to travel toward the right side in FIG. 3. Since mercury vapors or vapor atoms are charged in the glass tube, the thermal electrons 10 excite the mercury atoms in the course of their travel as to emit ultraviolet radiation which excites, in turn, a fluorescent film 9 coated on the inner wall surface of the glass tube 13, resulting in emission of light rays 7. Since the thermal electrons are deflected reversely after they pass through the opening 25 of the glow electrode 6, no shadow of the glow electrode 6 which is an enclosure, is visible through the glass tube, that is, the fluorescent lamp is lit on with uniform brightness.

Figure 4:
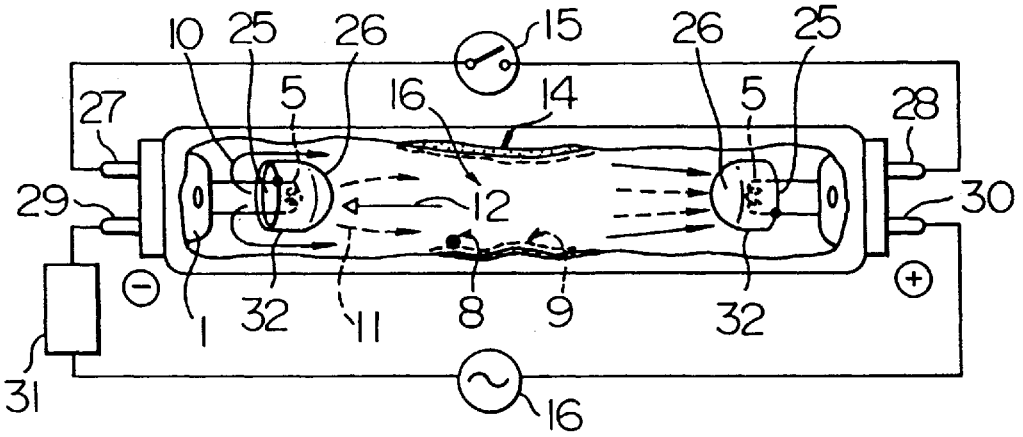
FIG. 4 is a schematic section view illustrating the structure of a composite discharge lamp in a second embodiment of the present invention.
Figure 12:
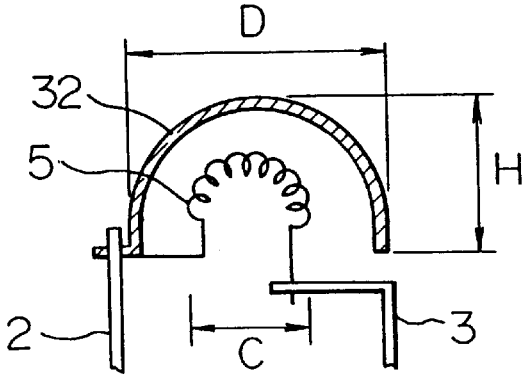
FIG. 12 is a sectional view illustrating the arrangement of an electrode assembly shown in FIG. 4, which is partly broken.

Referring to FIG. 4 which shows a second embodiment of the present invention, a dome-like shape glow electrode 32 as shown in FIG. 12 which is a sectional view, is incorporated. The glow electrode 32 has a diameter D of 8 mm, a height H of 4 mm, and incorporates therein a 10 W filament coil center electrode 5 formed of a wire and having a width C of about 4 mm, which is laid crosswise of the glass tube 14.

Referring to FIG. 4, the glass tube 14 has a diameter of about 25.5 mm, and a length of 33 cm, and is charged therein with 5 torr of argon gas and 0.006 mmHg of mercury vapor. Further, the inner surface of the glass tube 14 is coated thereover with a fluorescent substance film 9. The glass tube 14 has four base pins 27, 28, 29, 30, a glow starter 15 is connected between the base pins 27, 28 while an a.c. power source 16 and a stabilizer 31 are connected between the base pins 29, 30.

If the left side of the fluorescent lamp is negative (−), the thermal electrons 10 emitted from the filament coil center electrode 5 pass through the opening 25 of the glow electrode 26 and through the gap between the inner wall surface of the glass tube 14 and the outer wall surface of the glow electrode 32, and finally reach the opposite side positive (+) electrode assembly after traveling through the longitudinally middle part of the glass tube 14. Simultaneously, the outer peripheral wall surface of the glow electrode 32 including the bottom 26 is bombarded with ions 12 so as to generate secondary electrons 11 which are also attracted toward the positive side electrode assembly. That is, the lamp current runs through the longitudinally middle part of the glass tube 14 in such a condition that the thermal electrons 10 and the secondary electrons 11 are combined in the middle part. Substantial all of this lamp current reaches the outer peripheral wall surface, including the bottom surface, of the glow electrode 32 of the positive electrode assembly, but does not reach the filament coil center electrode 5 in the positive electrode assembly. Accordingly, less current runs in the vicinity of the opening 25 of the positive glow electrode 32 so that no light is emitted therearound.

However, since the power source 16 is an a.c. power source, the negative side and the positive side are alternated with each other at every half cycle of a.c. frequency waves, and as a result, bright light is emitted from the opposite end parts of the glass tube 14. In order to eliminate a shadow around the glow electrode as much as possible, the dome-like glow electrode 32 as shown in FIGS. 4 and 12 can be advantageously used, rather than the cylindrical glow electrode 6 shown in FIG. 3. Further, it is advantageous to decrease the diameter of the glow electrode to a minimum value provided that the glow electrode does not make contact with the filament coil center electrode.

Electrons generated on the negative side includes secondary electrons caused by glow discharge due to a potential difference (about 11 to 12 V) between the filament coil center electrode 5 and the glow electrode 32, in addition to the thermal electrons. Such electrons travel toward the positive electrode assembly through the opening 25. As mentioned above, since the emitter on the filament coil center electrode 5 within the glow electrode 32 is isolated from the energy of ion 5 bombardment, it is possible to eliminate sputtering thereof.

Although the emitter on the filament coil center electrode 5 is consumed due to its evaporation, the vapors of the emitter scatter and stick to the inner wall surface of the glow electrode 32. The thus adhered vapors of the emitter can also readily emit electrons, and accordingly, it causes the discharge current to increase. Alternatively, they further scatter and then again stick to the filament coil center electrode 5 or other parts, and accordingly, they emit electrons thereat.

Thus, the filament coil center electrode 5 is isolated from the ion bombardment so as to eliminate the sputtering, and further, the scattering of the vapors of the emitter caused by its take place between the inner wall surface of the glow electrode and the filament coil center electrode so that the emission of electrons can be successively effected, and accordingly, the consumption of the electrodes is significantly decreased. As a result, the useful life of the fluorescent lamp is greatly prolonged.

Figure 13:
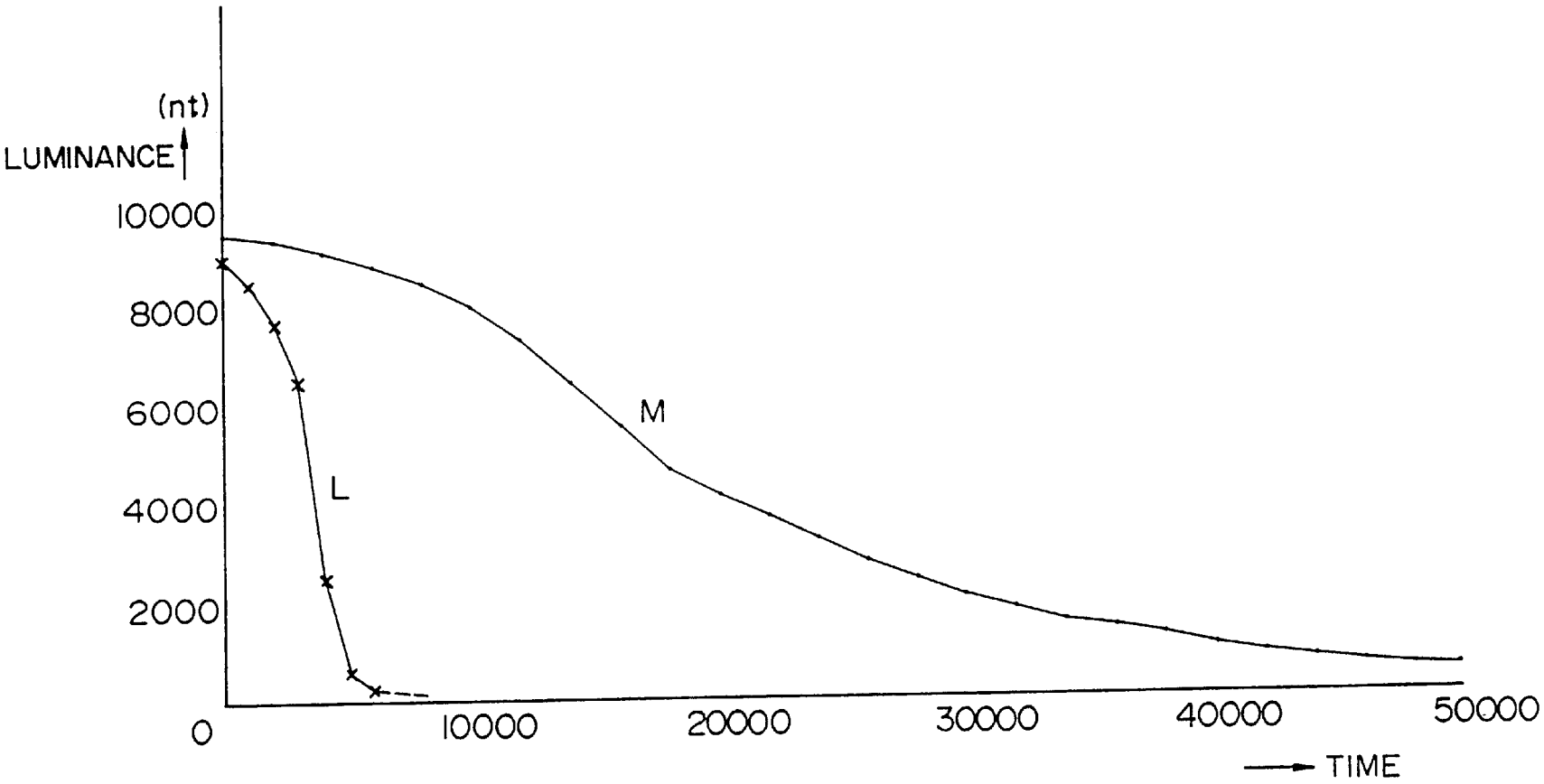
FIG. 13 is a graph showing use life characteristics of lamps, which are measured in the middle part of the glass tube, in which the use life characteristics of a conventional fluorescent lamp and a composite discharge lamp according to the present invention are shown for the purpose of comparison.

FIG. 13 is a graph for comparing the life of the composite discharge lamp in this embodiment of the present invention as shown in FIG. 4 with the life of the conventional fluorescent lamp generally used. In comparison between the life curve M of this embodiment of the present invention and the life curve L of the conventional fluorescent lamp, it is understood that the useful life of the composite discharge lamp according to the present invention is sustained so that it can be lit even after 50,000 hrs of operation, and accordingly, the useful life thereof is, indeed, about eight times as long as that of the conventional fluorescent lamp.

In general, a fluorescent lamp lowers its electron emitting ability in the later period of the life thereof, and accordingly, the voltage drop at the cathode electrode becomes large. Thus, the more the scattering of vapors of the emitter, the more the consumption, and therefore, the reduction in the useful life of the fluorescent lamp is accelerated. Simultaneously, the energy of ion bombardment causes generation of large amount of heat. For example, it has been confirmed that the temperature of the wall of each end part of the glass tube rises to a temperature of about 150 to 200 deg.C. As a result, an attachment fixture for the fluorescent lamp would be damaged, and in the case of the display of an image on a film with the use of an electric bulletin board or the like in which a color film is illuminated on opposite sides thereof, there would be raised a problem of discoloring of the color film.

According to the present invention, even though the ion bombardment becomes excessive in the later period of the use life of the composite discharge lamp according to the present invention, the radiation of secondary electrons becomes greater and greater so that the discharge current which contributes to the emission of light can be further increased. Since the glow electrode is designed to have a large heat capacity, no excessive bright spotting occurs, that is, stable electric discharge can be obtained without flickering. The wall thickness of the glow electrode is preferably set to a value in a range of 0.15 to 0.2 mm in view of its heat capacity.

Figure 6:
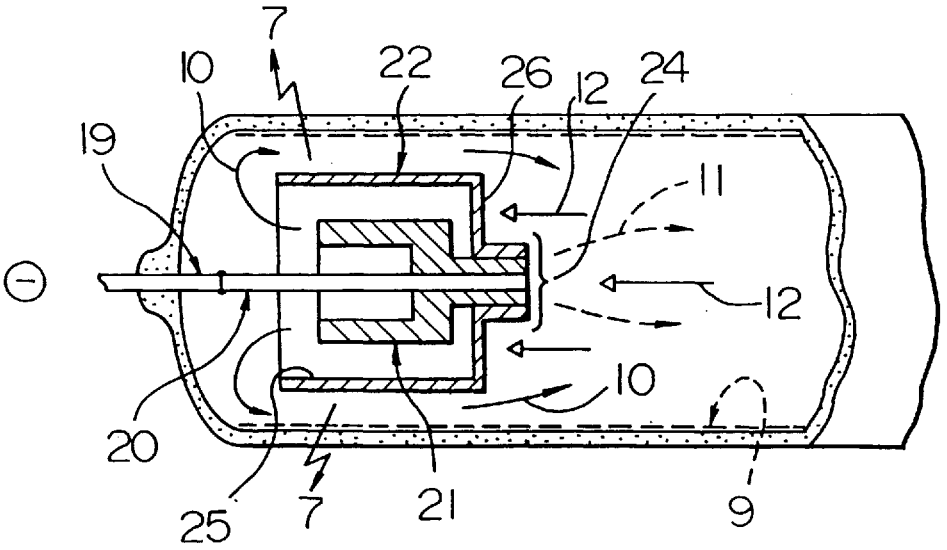
FIG. 6 is an explanatory view illustrating a part of the composite discharge lamp in a second embodiment of the present invention, which is partly broken.

FIG. 6 is a schematic sectional view which shows only the left side part of a composite discharge lamp in a third embodiment of the present invention. An electrode assembly shown in FIG. 6, is composed of a cup-like glow electrode 22 made of metal such as aluminum, and a cup-like arc electrode 21, that is, a center electrode located within the glow electrode 22 and made of sintered metal mainly composed of an electron emitting substance. A lead wire 19 is laid being aligned with the center axis of these electrodes, and is connected to a tungsten wire 20 in the vicinity of the electrodes. In this embodiment, the lead wire 19 is formed of a Dumet wire. The glow electrode 22, the arc electrode 21 and the tungsten wire 20 are caulked and fixed together so as to form a manifold end part 24.

In the composite discharge lamp constituted as shown in FIG. 6, an invertor 18 is connected between lead wires 19, 19. When a d.c. power source 17 is connected to the invertor 18, the composite discharge lamp is energized. The arrangement shown in FIG. 5, can suitably be used as a small size thin tube lamp having, for example, a diameter of about 3 mm, for back-lighting of a liquid crystal display panel.

Figure 5:
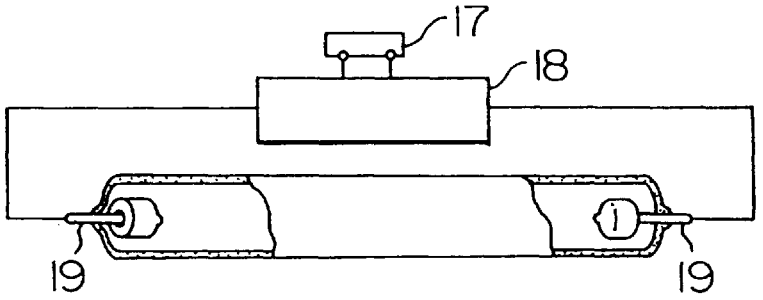
FIG. 5 is a view showing an electrical wiring for operating the composite discharge lamp in the first embodiment.

As to the embodiment shown in FIGS. 5 and 6, the following is an example of specific design:

Oscillating Frequency: 50 KHz, Oscillating Voltage 700 V (effective value), Charged Gas: 50 torr of argon and 5 mmHg of mercury, Outer Diameter of Glass Tube: 6.5 mm (Wall Thickness: 0.5 mm), Length of Glass tube: 250 mm, and Fluorescent Substance: three wave fluorescent substance:

Dimension of Electrode Assembly:

Glow Electrode:

Outer Diameter: 4.5 mm; Wall Thickness: 0.15 mm; and Barrel Length: 5 mm, Arc Electrode (center electrode): and Outer Diameter: 3.0 mm; Wall Thickness:

0.5 mm; Barrel Length: 2 mm, Electrode manifold end part:

Outer Diameter: 2 mm at the maximum; and

Lead Wire:

Diameter: 0.5 mm From results of experiments with this design example, it was confirmed that the luminance upon electric discharge at a discharge current of 16 mA, was 30,000 nt, and the use life thereof was 35,000 hrs.

The glow electrode 22 shown in FIGS. 5 and 6 is arranged such that the opening 25 thereof faces one end of the glass tube which is near thereto, and the bottom thereof faces the longitudinally middle part of the glass tube. Accordingly, the arc electrode, that is, the center electrode 21 is completely protected from the ion bombardment. Accordingly, no sputtering occurs, and the energy of bombardment by the ions 12 is absorbed by the outer peripheral wall so as to effect the emission of secondary electrons.

Figure 7:
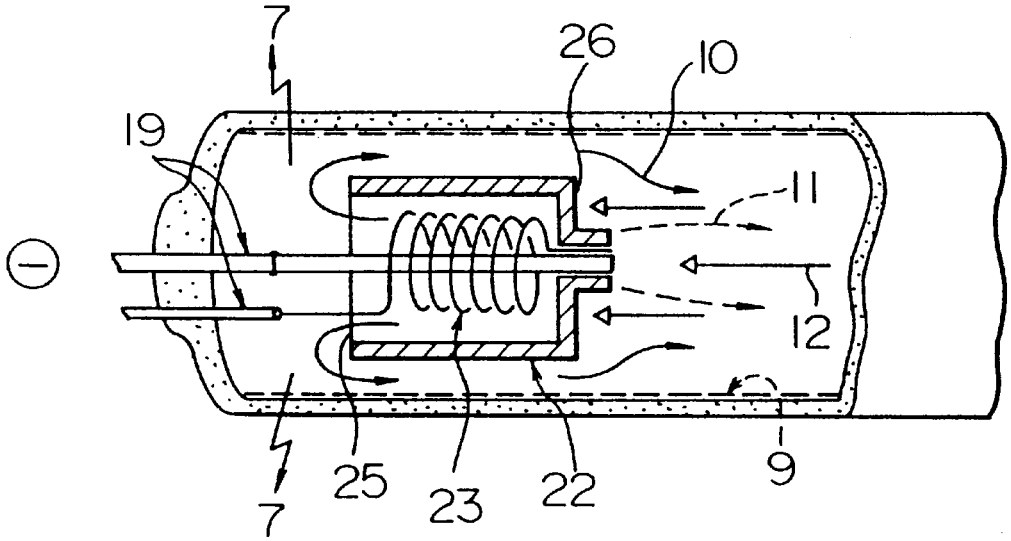
FIG. 7 is an explanatory view illustrating a composite discharge lamp in a third embodiment of the present invention, which is partly broken.
Figure 8:
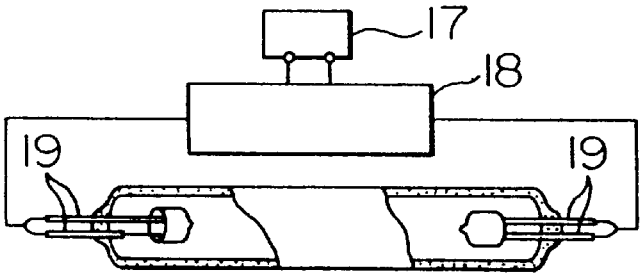
FIG. 8 is a view illustrating an electrical wiring for operating the composite discharge lamp in the third embodiment of the present invention.
Figure 9:
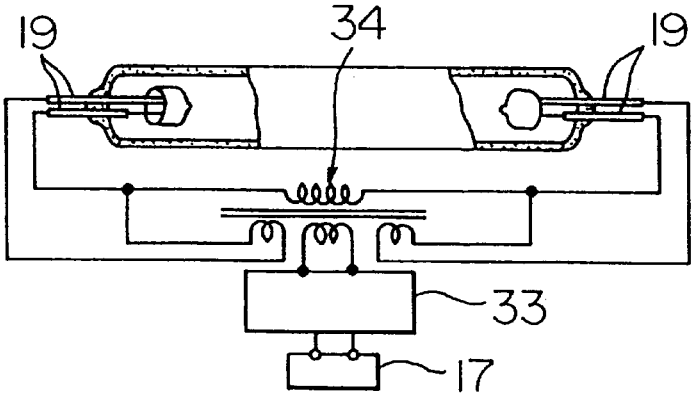
FIG. 9 is a view illustrating an another electrical wiring for operating the composite discharge lamp in the third embodiment of the present invention.

FIG. 7 is an explanatory view illustrating only the left part of a composite discharge lamp in a fourth embodiment of the present invention, which is partly broken. In difference from the composite discharge lamp shown in FIG. 6, a filament coil center electrode 23 is used as the arc electrode, and further, two lead wires 19 formed of Dumet wires are used. FIG. 8 shows an electrical wiring for energizing the composite discharge lamp shown in FIG. 7. This electric wiring is of a high voltage and high frequency turn-on system using an invertor. Another electrical wiring shown in FIG. 9 includes a high frequency oscillator 33 and an oscillating transformer 34 so as to constitute a rapid starter and a system turn-on circuit. In comparison between the electrode assemblies shown in FIGS. 6 and 7, the electrode assembly shown in FIG. 6 is advantageous since it has a longer use life. Meanwhile the electrode assembly shown in FIG. 7 is advantageous since it has a higher luminance.

Figure 10:
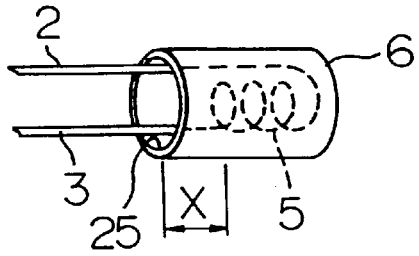
FIG. 10 is a perspective view showing the positional relationship between a glow electrode and a filament coil electrode.
Figure 11:
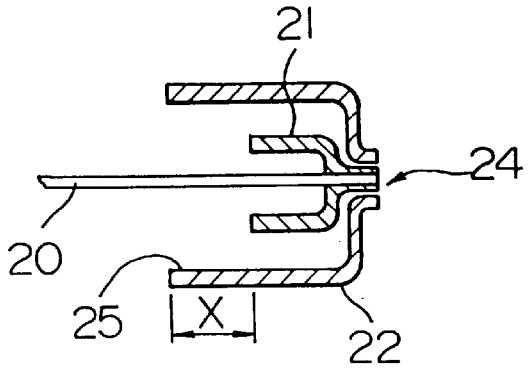
FIG. 11 is a sectional view illustrating the positional relationship between a glow electrode and an arc electrode.

It has been confirmed that a gap X in the order of several millimeters is preferably defined between the opening of the glow electrode and the center electrode. Referring to FIG. 10, the gap X is defined between the opening 26 of the glow electrode 6 and the proximal end part of the filament coil center electrode 5. Meanwhile, referring to FIG. 11, the gap X is defined between the opening 25 of the glow electrode 22 and the opening of the arc electrode 21. This gap X is preferably greater than 2 mm in the case of a small size thin tube composite discharge lamp, but is preferably greater than 4 mm in the case of a 10 W composite discharge lamp.

It is more preferable to coat the inner surface of the glow electrode with the emitter since it can enhance the emission of electrons. Although it has been explained, in the above-mentioned embodiments, that the glow electrode is made of metal such as aluminum, it is also possible to use a transparent electrically conductive glass therefor. This transparent electrically conductive glass can provide a more optically effective electrode. The glow electrode may have any shape such as a cylindrical shape, a cup-like shape, a funnel shape, a dome-like shape, a scaphoid shape or the like. However, it is noted here that, of the various metal materials for the glow electrode, the one with minimum sputtering was aluminum, which was more preferable if it has a purity of higher than 95%.

In order to produce the glow electrode made of transparent electrically conductive glass, for example, a sputtering film forming technology can be used, with which an electrically conductive thin film is formed all over the surface of the glow electrode with indium oxide doped with tin oxide. Alternatively, it is possible to use vacuum evaporation of high purity aluminum. Since the manifold end part of the glow electrode made of transparent electrically conductive glass cannot be fixed by caulking, and accordingly, it is fixed by using an electrically conductive adhesive.

Figure 14:
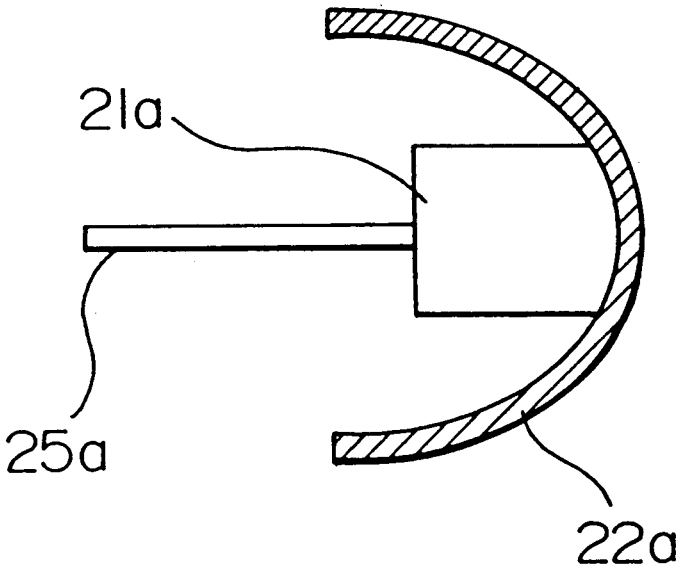
FIG. 14 is a sectional view illustrating a variant form of the composite discharge lamp shown in FIG. 6.
Figure 15:
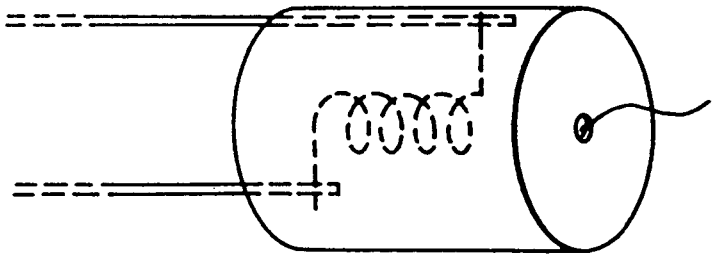
FIG. 15 is a perspective view illustrating a variant form of the composite discharge lamp shown in FIG. 2.

Referring to FIG. 14 which shows a variant form of the embodiment shown in FIG. 6, a cup-like glow discharge electrode 22*a* is fixed to the distal end of a lead wire 25*a*, and further, a round-rod-like center electrode 21*a* made of a sintered metal material is provided so as to surround the distal end part of the lead wire 25*a*. The round rod-like center electrode 21*a* is impregnated therein with electron emitting substance. Further, the end part of the center electrode 21*a* may be fixed to the cup-like glow discharge electrode 22*a*.

Further, as shown in FIG. 14, the dome-like glow discharge electrode 22*a* made as the transparent electrically conductive electrode is preferably used, in stead of the cylindrical glow electrode as shown in FIG. 2, 6, 7, 10 or 11, since a shadow of the dome-like glow discharge electrode is substantially not visible on the outer peripheral surface of the glass tube, and accordingly, the dome-like electrode 22*a* can give a satisfactory aesthetic appearance to the composite discharge lamp.

The glow discharge electrode 22*a* with less sputtering can be made of sintered metal which is composed of zirconium as a main component, tungsten and nickel, in addition to aluminum. Further, if the electrodes 21*a*, 22*a* are integrally formed with each other during molding and are then subjected to heat-treatment, it is possible to simplify the manufacturing process thereof.

In the case of the glow electrode having a closed bottom and having a diameter of about 10 mm (refer to FIGS. 2 and 12), a small hole having a diameter of about 0.5 to 2 mm, preferably about 0.5 to 1 mm is formed in the center part of the bottom of the glow electrode, and then the experiments were made for measurement of lighting. Even with this small hole, a long useful life and a high brightness could be obtained with no ion bombardment and no sputtering. With this arrangement, the start voltage became lower (by 3 to 5%) and the starting time was shortened. In the case of no small hole in the bottom of the glow electrode, the thermal electrons pass through the opening of the glow electrode and through the gap between the outer wall surface of the glow electrode and the inner wall surface of the glass tube, and accordingly, the electrical discharge impedance increases. On the contrary, in the case of the provision of the small hole in the center part of the bottom of the glow electrode, the thermal electrons pass through this small hole so as to increase the starting voltage and shorten the discharge time, that is, the provision of the small hole gives an assist to the main electric discharge.

Should the diameter of the small hole become larger, ion bombardment would occur, causing sputtering of the filament coil center electrode and high heat generation in the later period of the useful life. Meanwhile, should the diameter of the small hole become less, the start voltage would become lower and the time of lamp discharge becomes longer, that is, the above-mentioned assist would be meaningless. From experiments, it was confirmed that the diameter of the small hole was preferably in the range of 0.5 to 2 mm in which 0.5 to 1 mm was most preferable in the case of the glow electrode having a diameter of 10 mm.

According to the present invention, the useful life of the composite discharge lamp (the time until the lamp cannot be lit) can be remarkably prolonged, and substantially no blackening occurs of the opposite end parts of the glass tube. Further, no high heat generation occurs in the later period of the lamp life. Further, it is possible to prevent shadow from the glow electrode from being visible.

What is claimed is:

1. A composite discharge lamp comprising:

an elongated glass tube having an inner peripheral surface, opposite ends and between said opposite ends a longitudinal middle part;

electrode assemblies located in said glass tube respectively at said opposite ends thereof for connection to a power source;

each of said electrode assemblies comprising a center electrode carrying thereon an electron emitting substance for emitting electrons, and a glow discharge electrode formed of an enclosure having an inner peripheral surface, an outer peripheral surface, a closed end and an opposite end with an opening and housing therein said center electrode, said enclosure being arranged so that said opposite end with the opening faces a respective one of said opposite ends of the glass tube which is near thereto while said closed end faces said longitudinal middle part of said glass tube, said center and glow discharge electrodes having electrical connection and arrangement means for said center electrode to act as an arc electrode to said glow discharge electrode, to produce arc discharge between said center electrode serving as an arc discharge electrode and the inner peripheral surface of the enclosure of said glow discharge electrode, when said electrode assemblies are connected to said power source, so that electrons are then emitted from said center electrode of one of said electrode assemblies at one of said opposite ends of said glass tube, being assisted by said electron emitting substance, and flows along a path to exit from said enclosure through said opening and then pass through a gap between said inner peripheral surface of the glass tube and said outer peripheral surface of said enclosure and travel through said longitudinal middle part of said glass tube to the other one of said electrode assemblies at the other one of said opposite ends of the glass tube, the flow of said electrons producing light in said glass tube which is uniform in brightness therein without shadows produced by said electrode assemblies.

2. A composite discharge lamp as claimed in claim 1, wherein said opening is said opposite end of said enclosure is a small hole.

3. A composite discharge lamp as claimed in claim 2, wherein said enclosure has a diameter, at said opposite end with the hole of about 10 mm and said hole has a diameter of 0.5 to 2 mm.

4. A composite discharge lamp as claimed in claim 1, wherein said enclosure is made of material which extends to said outer peripheral surface of the enclosure and directly subjected to ion bombardment produced by the travel of said electrons which in said gap between said outer surface of said enclosure and said inner peripheral surface of the glass tube.

5. A composite discharge lamp as claimed in claim 4, wherein said inner peripheral surface of the glass tube has a fluorescent film applied thereto.

6. A composite discharge lamp as claimed in claim 4, wherein said enclosure is made of substantially pure aluminum.

7. A composite discharge lamp as claimed in claim 4, wherein said enclosure is made of substantially transparent electrically conductive glass.

8. A composite discharge lamp as claimed in claim 1, wherein said enclosure has a dome shape.

9. A composite discharge lamp as claimed in claim 1, wherein said enclosure is made of material which extends to and forms said outer surface of the enclosure.

10. A composite discharge lamp as claimed in claim 1 wherein said outer peripheral surface of said enclosure and said inner surface of said glass tube face one another so that said gap is formed therebetween without any obstruction to the passage of the electrons therethrough.

11. A composite discharge lamp as claimed in claim 1 wherein said outer surface of said enclosure is bare, and is formed by the material of said enclosure.

12. A composite discharge lamp as claimed in claim 11, wherein an open space is formed between the inner surface of the glow discharge electrode and the outer surface of the center electrode to enable formation of said arc discharge between the center electrode and the glow discharge electrode.

* * * * *